US005426864A

United States Patent [19]

Svehaug et al.

[11] Patent Number: 5,426,864

[45] Date of Patent: Jun. 27, 1995

[54] VACUUM BELT PRESS DRYER

[76] Inventors: Henry V. Svehaug, 114 SW. 5th, Milton-Freewater, Oreg. 97862; John N. Hallinan, P.O. Drawer 25150, 5135 SW. 85th Ave., Portland, Oreg. 97225

[21] Appl. No.: 198,525

[22] Filed: Feb. 17, 1994

[51] Int. Cl.[6] ..... F26B 19/00

[52] U.S. Cl. ..... 34/70; 34/398;399; 100/106;118; 210/386

[58] Field of Search ..... 34/92, 388, 398, 399, 34/70; 100/106, 118

[56] References Cited

U.S. PATENT DOCUMENTS

| | | | |
|---|---|---|---|
| 2,338,777 | 1/1944 | Millspaugh . | |
| 2,823,806 | 2/1958 | Harlan . | |
| 3,699,881 | 10/1972 | Levin et al. . | |
| 3,741,388 | 6/1973 | Takahashi . | |
| 4,289,616 | 9/1981 | Hallack et al. . | |
| 4,310,424 | 1/1982 | Fremont et al. . | |
| 4,483,770 | 11/1984 | Casey et al. . | |
| 4,568,460 | 2/1986 | Bratten . | |
| 5,000,850 | 3/1991 | Berry . | |
| 5,041,222 | 8/1991 | O'Dell | 210/386 |
| 5,133,883 | 7/1992 | Prinssen . | |
| 5,238,501 | 8/1993 | Kappel et al. | 134/15 |

*Primary Examiner*—Henry A. Bennett
*Assistant Examiner*—Siddharth Ohri
*Attorney, Agent, or Firm*—Klarquist Sparkman Campbell Leigh & Whinston

[57] ABSTRACT

A belt dryer for dewatering fine particle suspensions includes a continuous conveyor belt with a slotted vacuum pipe disposed beneath a dewatering station, a support below the conveyor belt adjacent the dewatering station immediately downstream of the slotted pipe, and a press roll above the conveyor belt and adapted to exert pressure on the support bar to create an even film of suspension over the slot which facilitates extraction of filtrate.

9 Claims, 4 Drawing Sheets

110
101
100
54
10
46
52
44

104
46
101
44
6
6
5
5
100
52
110
10
54
4

10
100
110
54
52

2
30
32
38
40
34
46
42
48
106
103
104
44
46
110
100
108
108
102
52
98
94
102
18
52
4
50
86
96
98
76
74
80
36
22
80
28
82
81
24
24
26
67
62
65
10
164
166
2

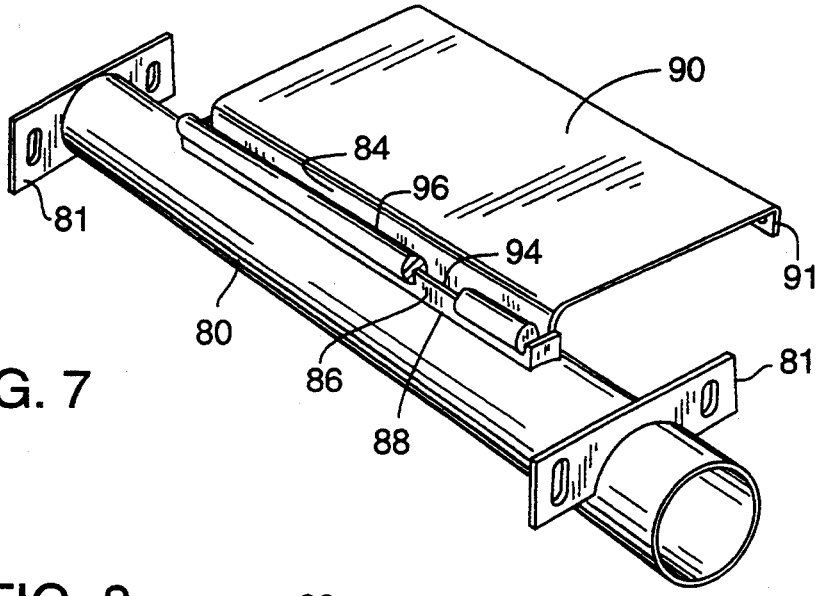
FIG. 7
FIG. 8
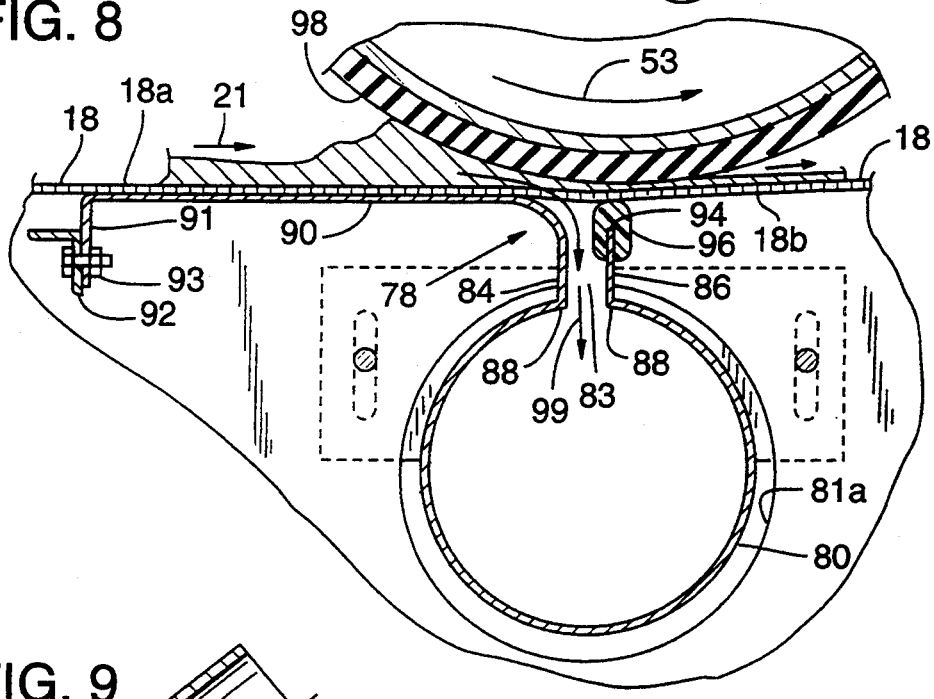
FIG. 9
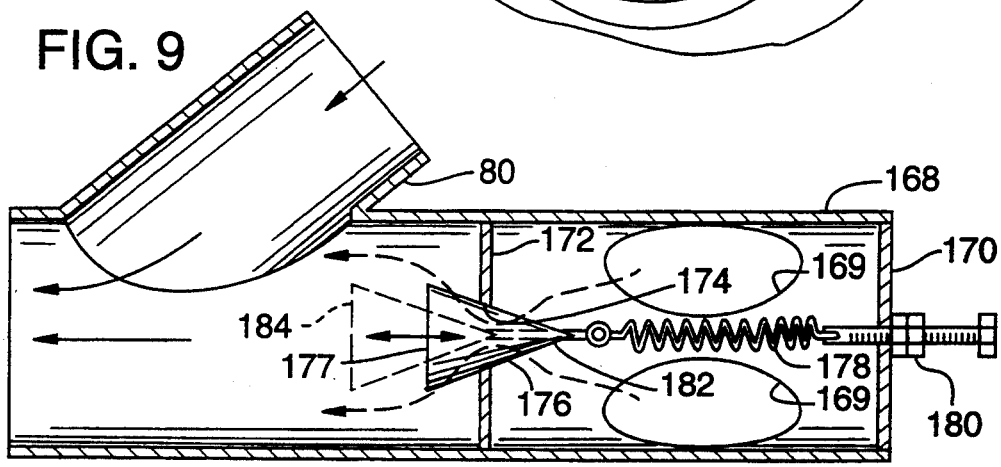

VACUUM BELT PRESS DRYER

FIELD OF THE INVENTION

This invention relates to vacuum belt dryers and, more particularly, to such dryers adapted to convert a solution containing a very low amount of solids, such as a slurry or a very wet sludge, to a relatively dry product.

BACKGROUND OF THE INVENTION converting a slurry or a highly liquified sludge containing a relatively low solids content to a relatively dry product constitutes a difficult problem. Presently available systems often use flocculants, polymers or other chemicals for this purpose. Such, however, are not only expensive, but they actually inhibit the extraction of liquid from the sludge or slurry. Some presently available apparatus utilize rotating vacuum filters, but these often are complicated and fail to achieve a relatively dry final product.

It is thus the primary object of the present invention to provide a vacuum dryer that can accommodate a continuous infeed of a highly liquified slurry or sludge, one containing as much as ninety-nine percent water, and convert it to dried solids at perhaps as little as twenty percent moisture content, without the use of any flocculants, polymers or other chemicals.

It is a further object of the present invention to provide apparatus of the type described that will discharge a relatively clear effluent.

It is a still further object of the present invention to provide apparatus of the type described that is capable of handling a wide variety of sticky and/or toxic solutions.

It is a still further object of the present invention to provide apparatus of the type described that can function either as a stationary piece of apparatus or as portable apparatus.

SUMMARY OF THE INVENTION

The dryer of the present invention is particularly suitable for dewatering fine particle suspensions that are highly liquid, that is, that have a very low solids content, and converting them into a relatively dry solid end product.

The apparatus comprises a continuous generally horizontal belt having an upper transport flight and a lower return flight, the upper flight being adapted to carry an aqueous solution of fine particles in a highly liquified form.

A filtrate dewatering station is disposed at a point below the upper transport flight. Suction means for applying vacuum pressure are disposed below the upper transport flight at the dewatering station. Vacuum pressure is applied by means of a vacuum pipe which extends transversely of the belt. The pipe has a slot extending the width of the belt. The slot is adapted to receive filtrate drawn through the belt at the dewatering station by the suction means.

A support is disposed beneath the transport flight adjacent the dewatering station immediately downstream of the slot in the vacuum pipe. A pressing roller, which may be a rubber-lagged roller, is disposed above the transport flight at the dewatering station. Means are provided to urge the pressing roller against the support to apply pressure to the aqueous suspension on the transport flight. The amount of pressure is selected so as to create a slight damming effect upstream and thus a relatively even film of aqueous suspension over the slot in the vacuum pipe, the combination facilitating extraction of liquid from the sludge or slurry.

BRIEF DESCRIPTION OF THE DRAWINGS

FIG. 7 is a perspective view of the vacuum pipe at the dewatering station;

FIG. 8 is a sectional view to an enlarged scale at the dewatering station, illustrating the attachment of the vacuum pipe, the pressing roller and the support positioned therebelow; and FIG. 9 is a sectional view of a vacuum pressure control suitable for use with the invention.

DESCRIPTION OF THE PREFERRED EMBODIMENT

Figure 2:
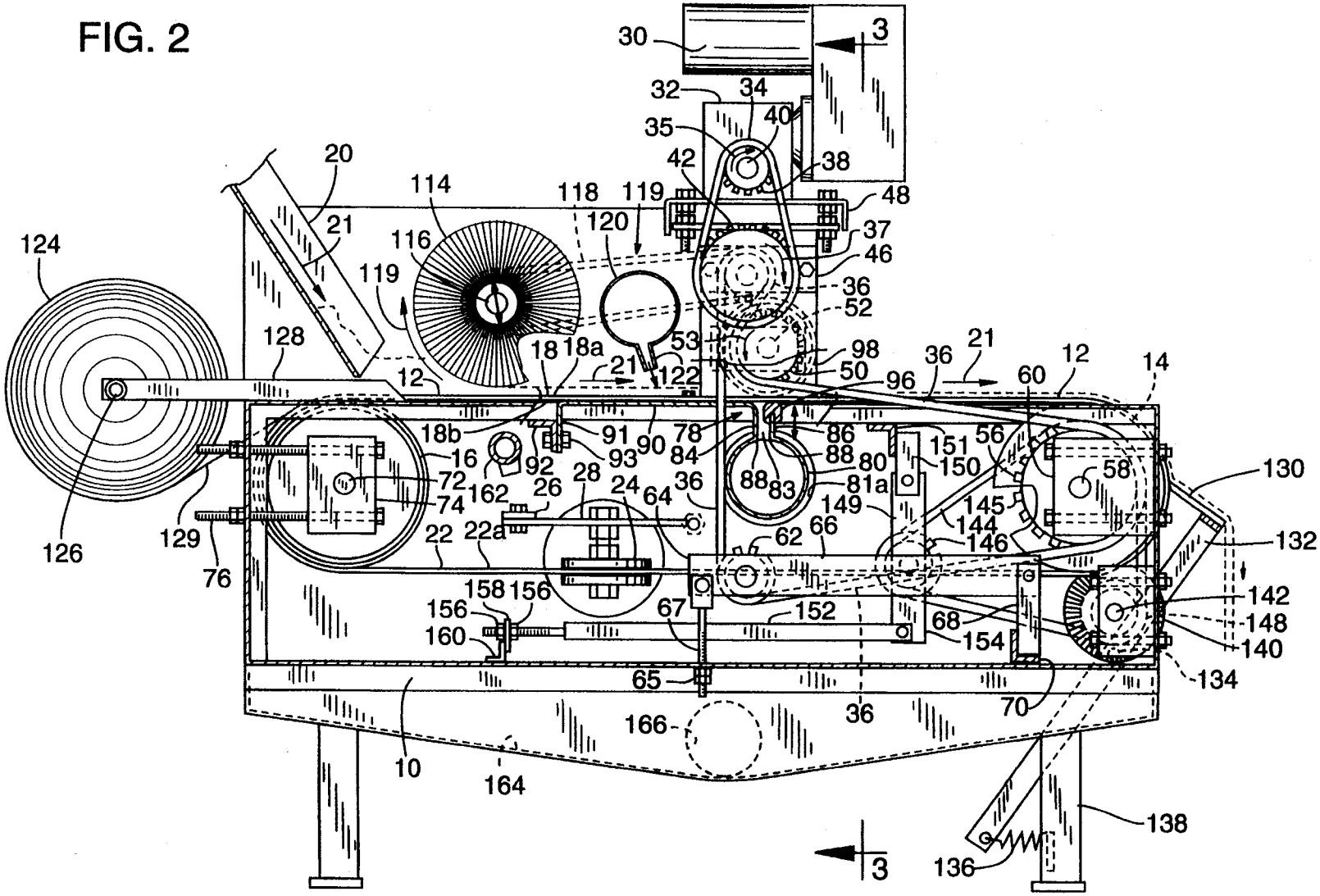
FIG. 2 is a longitudinal, partially schematic, cross sectional view through the dryer of FIG. 1.
Figures 3, 4, 5, 6:
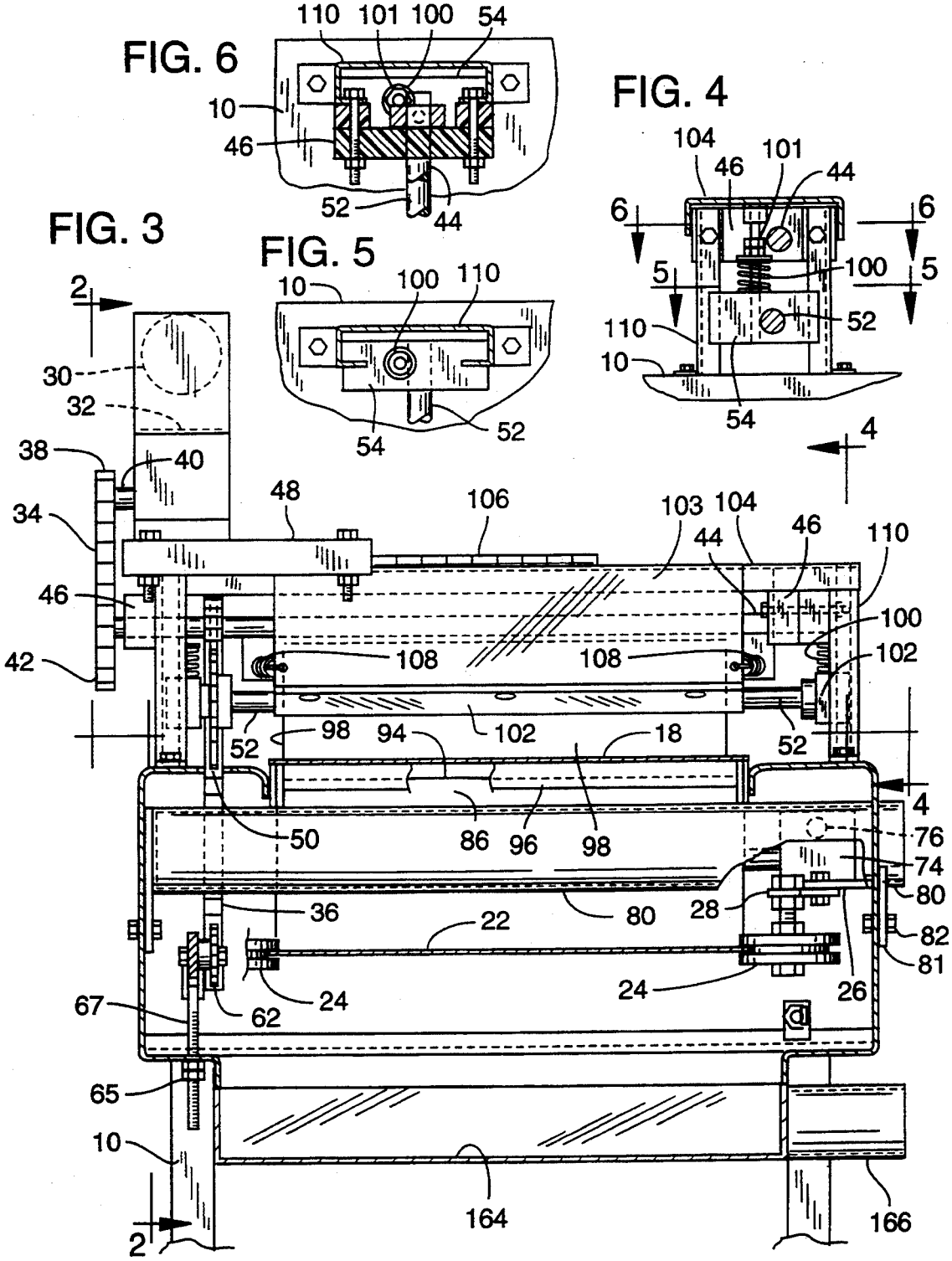
FIG. 3 is a sectional view taken on line 3—3 of FIG. 2.
FIG. 4 is a sectional view taken on line 4—4 of FIG. 3.
FIG. 5 is a sectional view taken on line 5—5 of FIG. 4.
FIG. 6 is a sectional view taken on line 6—6 of FIG. 4.

Referring to the drawings, the belt dryer of the present invention comprises a stand-alone type frame 10, which makes the apparatus portable so it can be used at remote locations or where there is no available electric power. A continuous horizontal conveyor belt 12, made of porous woven monofilament polyester mesh, is entrained over a drive roller 14 and an idler roller 16, as shown in FIG. 2. Belt 12 is typically sixteen or thirty-two inches wide, depending on the desired size of the dryer, and is typically of 230 mesh, although other mesh openings can be used depending on the product. Belt 12 has an upper transport flight 18, which receives the various slurries and sludges through an intake chute 20 (flow in the direction of arrows 21), and a lower return flight 22, disposed below upper flight 18, and centered by centering rollers 24 mounted on transversely adjustable brackets 26 (see FIG. 3) and vertically adjustable by means of a pivot arm 28 (see FIG. 2).

Drive roll 14 is powered by a one or one-half horsepower varispeed drive motor 30 (again depending on apparatus size) through a gear reduction 32 by a drive chain 34 and a driven chain 36 which travel in the direction of arrows 35 and 37, respectively. Chain 34 is received on a drive sprocket 38 mounted on a shaft 40. Chain 34 drives a sprocket 42 mounted on a shaft 44 received in a bearing 46, the tension in chain 34 being adjusted by a chain tightener 48.

Driven chain 36 is entrained over a sprocket 50 mounted on a shaft 52, which rotates in the direction of arrow 53 and is received in bearings 54, thence over a sprocket 56 which drives roller 14 on a shaft 58 mounted in an ultra high molecular weight (UHMW) plastic bearing 60. Chain 36 thence passes over an adjustably positioned sprocket 62, whose vertical position (and thus the tension in chain 36) is adjustable by raising or lowering an end 64 of a pivotal support 66 mounted on an arm 68 supported by a bracket 70 attached to frame 10. End 64 is raised or lowered by adjusting nuts 65 attached to a rod 67 attached to support 66. See FIG. 2.

Idler roller 16 is mounted at the opposite (upstream) end of frame 10 on a shaft 72 supported in a UHMW plastic bearing 74, which itself is longitudinally adjustable by virtue of being mounted on adjustable rods 76 (see FIG. 2). This permits application of the appropriate tension to belt 12.

Figure 1:
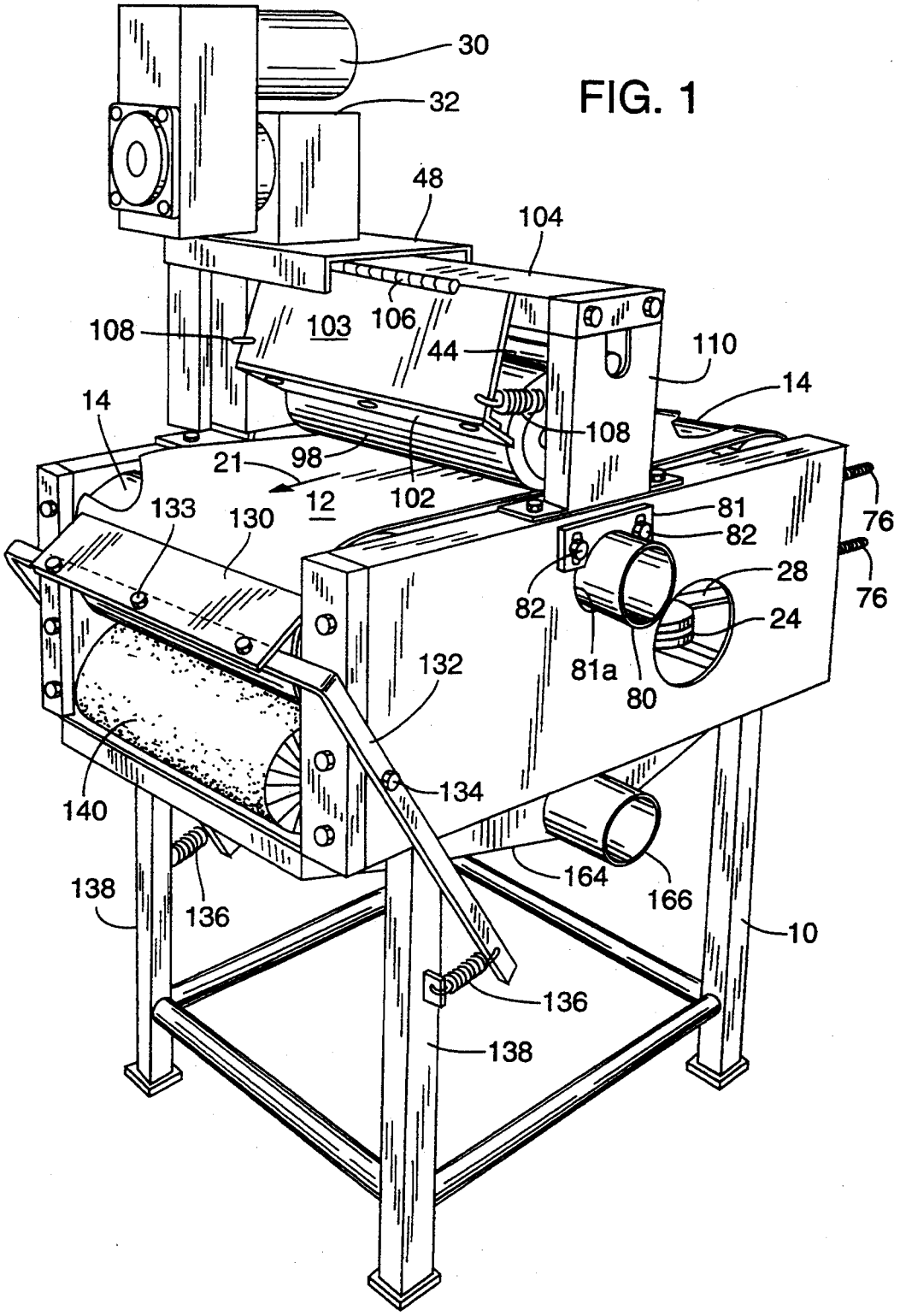
FIG. 1 is a perspective view of a vacuum belt press dryer according to the present invention.

The actual application of vacuum pressure which accomplishes the dewatering of the sludges and slurries occurs at a dewatering station 78 which is located generally in the middle of upper transport flight 18. A six-inch diameter vacuum pipe 80 attached to a vertically adjustable plate 81, pipe 80 passing through openings 81*a* in the sides of the dryer, plate 81 being attached to the dryer by bolts 82 (see FIG. 1), is connected to a vacuum pump (not shown) and is disposed below upper flight 18, extending transversely across the width thereof. Pipe 80 is provided with a one-quarter inch wide slot 83, which also extends transversely fully across the width of belt 12, and is the means through which vacuum pressure is actually applied to the under surface of upper flight 18.

A pair of flanges 84, 86 are attached as by welding to the transversely extending edges 88 of slot 83 in vacuum pipe 80. See FIGS. 7 and 8. The upstream flange 84 terminates in a horizontal support plate 90 which has a downwardly depending flange 91, which latter is attached to a bracket 92 attached to frame 10 by bolts 93. See FIGS. 2, 7 and 8. The downstream flange 86 is attached at its upper end 94 to a plastic support bar 96, which also extends transversely fully across and underneath the width of upper flight 18 as shown.

A twelve-inch diameter rubber-lagged pressing roller 98 is mounted on shaft 52 and is driven in the direction of arrow 53 by chain 36. Roller 98 is adapted to provide adjustable pressure on the sludge or slurry carried by the upper surface 18a of upper transport flight 18 directly over support bar 96, such that, between them, roller 98 and support bar 96 exert pressure on the sludge or slurry and on belt 12, damming up the material upstream of roller 98 (see FIG. 8) and squeezing liquid out of the slurry or sludge, thus serving as a metering or levelling device so that a relatively even film passes over slot 83, whereby the liquid filtrate may be extracted through pipe 80 and then pass in the direction of arrows 99 to a balance tank (not shown).

Downward pressure on roller 98 is adjustably provided by compression springs 100, which are adjusted by locknuts 101, such that springs 100 exert downward force on bearings 54 in which shaft 52 is journaled. See FIGS. 3 and 4. It will be noted that support bar 96 is positioned immediately downstream of slot 83 in pipe 80 and underneath the point of tangency of spring-loaded pressing roller 98. The arrangement serves to compress the sludge or slurry on belt 12, facilitates the release of water for vacuum evacuation, creates the damming effect upstream of the pressure point, which was described above and illustrated in FIG. 8, and serves to even out the depth of the sludge or slurry on belt 12.

It is this particular combination which renders the vacuum extraction of liquid through the sludge or slurry highly efficient and enables sludges or slurries containing as much as ninety-nine percent water to be dried to solids containing as little as twenty percent moisture. The arrangement also makes it possible to achieve liquid extraction without the use of any flocculants, polymers or other chemicals. Polymers and flocculants used in liquid extraction actually inhibit the same because of their slippery nature. The fact that chemicals are not used also results in a significant savings in operating cost. A doctor blade 102 attached to a pivotal support plate 103 is attached to an upper horizontal channel member 104 by a piano hinge 106 and is urged into scraping contact with roller 98 by springs 108 adjustably attached to vertical supports 110 mounted on the sides of the apparatus. See FIGS. 1 and 3. Doctor blade 102 serves to remove any excess matter which may adhere to the downstream surface of roller 98 after such surface passes over slot 83.

An adjustable load leveller in a form of a rotating brush 114 disposed upstream of dewatering station 78 is journaled on a shaft 116 and driven by a chain 118 powered by chain 34 and shaft 44. See FIG. 2. Brush 114 rotates in the direction shown by arrow 119, which is opposite to the direction of rotation of roller 98. Along with roller 98, brush 114 serves to regulate the depth of sludge or slurry on belt 12 as it approaches dewatering station 78.

A hot air "knife" 119 comprising a pipe 120 having a slotted, transversely extending discharge spout 122 extending fully across belt 12 and supplied with hot air from the exhaust of the vacuum pump (not shown), is positioned between brush 114 and roller 98. See FIG. 2. Hot air emitted through spout 122 serves to push moisture down to the underside 18*b* of flight 18 where the moisture can be more easily extracted by vacuum pipe 80, roller 98 at the dewatering station 78 "pinch point" further serving to squeeze out any free moisture.

When the apparatus is used to dewater particularly sticky or toxic sludges, an optional filter paper overlay may be used. Therefore, a filter paper roll 124 is provided and is journaled on a shaft 126 supported on arms 128 attached to frame 10 at the upstream end of the apparatus. See FIG. 2. Filter paper 129 taken from roll 124 overlays belt 12 and travels therealong, being taken up after it passes roller 14. Paper 129 is preferably a porous paper, the exact type selected depending on the needs of the product to be dewatered. Paper 129 serves to keep belt 12 clean in cases where the sludge or slurry is particularly sticky or where the solids content of the sludge or slurry comprises very fine particles which might otherwise either pass through belt 12 or stick to it.

Besides use of the paper overlay, belt 12 is kept clean by a second doctor blade 130 attached to a pivotable support bracket 132 by bolts 133, bracket 132 being hingedly attached to frame 10 at points 134. Blade 130 is urged into contact with belt 12 by springs 136 attached to the downstream legs 138 of frame 10 and scrapes dewatered solids from the belt. See FIG. 1.

A rotating bristle brush 140 journaled on a shaft 142 and powered by a chain 144 sweeps belt 12 at the beginning of its lower return flight 22 of any material which might continue to stick thereto. See FIG. 1. Chain 144 is driven by a sprocket 145 attached to shaft 58 (which also carries sprocket 56), chain 144 passing over a driven sprocket 146, thence driving brush 140 by means of a sprocket 148 attached to shaft 142. The tension on chain 144 is adjusted by longitudinal adjustment of sprocket 146 which itself is mounted on a hinged support 149, which is-pivoted on an arm 150 attached to a bracket 151, the longitudinal position of sprocket 146 being adjusted by a rod 152 hingedly attached at the lower end 154 of support arm 149 by means of adjusting nuts 156 which bear against a stop 158 attached to a bracket 160 attached to frame 10. See FIG. 2.

A final means for cleaning lower return flight 22 of belt 12 is provided in a form of a pressure wash 162 positioned below upper transport flight 18 and adapted to spray water on the upper (inner) surface 22*a* of lower return flight 22 to force any remaining particles through the belt, into a catch basin 164 below frame 10 and thence out a four-inch drain 166. See FIGS. 1 and 2. Pressure wash 162 may emit water at tap water temperature, it may emit hot water, or it may emit steam, as may be required.

Referring to FIG. 9, vacuum pressure in vacuum pipe 80 is held constant regardless of the load on belt 12 by a vacuum pressure control shown therein. Vacuum pipe 80, which is in communication with the vacuum pump, is provided with a control pipe spur 168 having openings 169 to the atmosphere and an end cap 170. An internal wall 172 is provided in spur 168. Wall 172 has a two-inch diameter central opening 174 in which is seated an eight-inch long conical control 176 (end 177 thereof preferably being two and one-quarter inches in diameter) attached by a spring 178 to end cap 170, tension in spring 178 being adjustable as desired by adjusting nuts 180, as shown. Conical control 176 is thereby adjustable from a position 182, when there is a full load on belt 12, to a position 184, when there is a light or negligible load on belt 12, thereby to protect the vacuum pump from creating too high a vacuum. The vacuum pump desirably should be capable of producing a maximum vacuum pressure of 22 inches of mercury. With a porous belt 12 and no product on it, the vacuum control will provide an effective vacuum at dewatering station 78 of three inches of mercury; when there is a paper overlay but no product on it, the control will provide an effective vacuum of five inches of mercury; and when there is a relatively thick slurry on the belt, the control will provide a vacuum of twenty inches of mercury.

OPERATION

A sludge or slurry to be dewatered is deposited on paper 129 overlaying belt 12 by means of intake chute 20 and is thereafter leveled by rotating brush 114, whose bristles move opposite to the direction of flow at the surface of belt 12. See FIG. 2. Hot air emitted through spout 122 of hot air knife 119 pushes moisture in the sludge or slurry down to the underside of belt 12. The rotation of rubber-lagged roller 98, pressing against support bar 96, further exerts downward pressure on the slurry or sludge, squeezing liquid out of it and further serving as a metering or levelling device so that an even film passes over slot 83, facilitating extraction of liquid through pipe 80. Relatively dry solids remaining on paper 129 and belt 12 are removed by doctor blade 130 and bristle brush 140. Any matter remaining on roller 98 is removed by doctor blade 102. Any particles remaining on lower return flight 22 are forced through by means of the emission from pressure wash 162, being forced into catch basin 164 and thence being removed through drain 166.

The apparatus is capable of dewatering suspensions containing as little as one percent solids and converting it to a product containing eighty percent or more solids. Slurries or sludges suitable for treatment for dewatering include sewage such as municipal secondary sludges, paint spray curtain sludges, toxic or hazardous wastes, and vegetable wastes such as potato or tomato processors' wastes. (Potato wastes, for example, are very starchy, and difficult to separate water therefrom.)

The apparatus is also useful for dewatering dust-collecting liquid effluents, for example, effluents containing rubber particles from tire factories, which have about ten percent solids content at their start, and converting them to sixty percent or more solids. Paint sludges typically contain ten to twenty percent solids and can be dewatered to fifty percent or higher solids content. With additional hot air drying downstream of the apparatus, it is possible to go from an almost total liquid suspension to twenty percent moisture as above noted.

We claim:

1. A belt dryer for dewatering particle suspensions, comprising:

a continuous horizontal belt having an upper transport flight adapted to carry an aqueous suspension of particles and a return flight disposed below the transport flight;

a filtrate dewatering station disposed at a point below the upper transport flight;

a vacuum pipe disposed below the upper transport flight at the dewatering station, the vacuum pipe extending transversely of the belt, the pipe being provided with a single slot extending the width of the belt;

suction means in communication with the vacuum pipe and adapted to apply vacuum pressure to the slot, the slot being adapted to receive filtrate drawn through the belt at the dewatering station by the suction means;

a press roll disposed above the transport flight at the dewatering station immediately downstream of the slot in the vacuum pipe, the press roll extending fully across the width of the transport flight;

a support bar disposed beneath the transport flight adjacent the dewatering station, the support bar extending fully across the transport flight and being disposed directly underneath the press roll; and means to urge the press roll toward the support bar to apply a predetermined amount of pressure to the aqueous suspension on the transport flight at the dewatering station, the amount of pressure being so selected as to create an even film of aqueous suspension over the slot in the vacuum pipe to facilitate extraction of filtrate therefrom.

2. A dryer as in claim 1, further comprising means to dispose a layer of filter paper over the transport flight.

3. A dryer as in claim 1, further comprising means to remove remaining solid material from the transport flight down-stream of the dewatering station.

4. A dryer as in claim 3, wherein the solid material removing means comprises a doctor blade disposed at the end of the transport flight and adapted to scrape dewatered solid material therefrom.

5. A dryer as in claim 3, wherein the solid material removing means comprises a bristle brush disposed at the end of the transport flight and adapted to sweep dewatered solid material therefrom.

6. A dryer as in claim 3, further comprising a water spray disposed above the return flight, the spray being adapted to discharge a spray of water on the return flight to wash any remaining solid material therefrom.

7. A dryer as in claim 1, further comprising means to discharge heated air above the transport flight at a point upstream of the dewatering station, the heated air serving to push liquid towards the underside of the transport flight to facilitate extraction of filtrate at the dewatering station.

8. A dryer as in claim 1, further comprising a suspension leveling brush rotatably journaled above the transport flight at a point upstream of the dewatering station.

9. A dryer as in claim 1, further comprising vacuum control means disposed in the vacuum pipe and adapted to control the amount of vacuum pressure in the vacuum pipe at the dewatering station.

* * * * *